US009681755B1

(12) United States Patent
Schober

(10) Patent No.: US 9,681,755 B1
(45) Date of Patent: Jun. 20, 2017

(54) WATER CHAIR WITH ATTACHMENTS

(71) Applicant: Thomas Charles Schober, Mission Viejo, CA (US)

(72) Inventor: Thomas Charles Schober, Mission Viejo, CA (US)

( * ) Notice: Subject to any disclaimer, the term of this patent is extended or adjusted under 35 U.S.C. 154(b) by 0 days.

(21) Appl. No.: 15/171,682

(22) Filed: Jun. 2, 2016

Related U.S. Application Data

(60) Provisional application No. 62/170,334, filed on Jun. 3, 2015.

(51) Int. Cl.

| | |
|---|---|
| ***A47C 15/00*** | (2006.01) |
| ***E04H 4/14*** | (2006.01) |
| ***A47C 7/74*** | (2006.01) |
| ***A47C 7/66*** | (2006.01) |
| ***A47C 7/68*** | (2006.01) |

(52) U.S. Cl.
CPC ..... *A47C 15/006* (2013.01); *A47C 7/66* (2013.01); *A47C 7/68* (2013.01); *A47C 7/742* (2013.01); *E04H 4/14* (2013.01)

(58) Field of Classification Search
CPC ..... A47C 15/006; A47C 7/66; A47C 7/68; B63C 9/30; E04H 4/14
USPC ..... 297/452.2, 184.17, 184.16, 170
See application file for complete search history.

(56) References Cited

U.S. PATENT DOCUMENTS

| | | | | |
|---|---|---|---|---|
| 4,358,866 | A * | 11/1982 | Rhodes | A47C 15/006 114/363 |
| 4,837,869 | A * | 6/1989 | Simmon | E04H 4/14 297/14 |
| 4,961,535 | A * | 10/1990 | Skibik | A47C 1/14 239/279 |
| 5,307,527 | A | 5/1994 | Schober | |
| 6,547,202 | B2 * | 4/2003 | Paton | A47K 3/001 248/441.1 |
| 8,783,765 | B1 * | 7/2014 | Matus | A47D 1/10 297/147 |
| 9,474,380 | B2 * | 10/2016 | Chlapaty | A47C 15/004 |
| 2014/0292041 | A1 * | 10/2014 | Horowitz | A47C 1/14 297/35 |

* cited by examiner

*Primary Examiner* — Milton Nelson, Jr.
(74) *Attorney, Agent, or Firm* — Plager Schack LLP

(57) ABSTRACT

Some embodiments of the present disclosure include a multi-purpose water chair for partially submerging a user in a body of water. The water chair may include a frame formed of tubing, the frame configured to engage with a wall in the body of water; a seat supported by the frame; a backrest supported by the frame; at least one cylindrical foam pad encircling portions of the frame, such that the water chair can be used as a flotation device and the user is not completely submerged in the body of water; an umbrella attached to the frame of the chair, the umbrella configured to extend upwards from the frame to shade a user; a mister attached to the frame, the mister having a spray nozzle and a tubing extending from the spray nozzle to the body of water; and a floatable and rotatable tray attached to the frame.

6 Claims, 4 Drawing Sheets

WATER CHAIR WITH ATTACHMENTS

RELATED APPLICATION

This application claims priority to U.S. provisional patent application Ser. No. 62/170,334 filed on Jun. 3, 2015, the entire contents of which is herein incorporated by reference.

BACKGROUND

The embodiments herein relate generally to a water chair, and more particularly, to a water chair with accessories attached thereto.

Existing stationary chairs and flotation devices to not allow for one chair to serve both purposes. Rather, existing products can either function as a stationary chair or as a flotation device. An existing water chair is described in U.S. Pat. No. 5,307,527, the entire contents of which is herein incorporated by reference. However, this existing chair must rest along the perimeter of a pool to be held in a usable position. Thus, it is not designed to be used in other bodies of water, such as lakes, rivers, and the like.

Moreover, existing stationary or floating water chairs that are designed to allow a user to be partially submerged in water fail to include a mechanism for attaching a shading device, such as an umbrella thereto. Additional attachments, such as trays and misters also are not available for the existing water chairs. Existing misters are separate devices that require canisters or other structural features to hold the water, and such structural features can be heavy and cumbersome.

Therefore, what is needed is an improved water chair configured to function as both a stationary chair partially submerged in water and a free floating chair partially submerged in water, wherein attachments, such as a shading device, a tray, and a mister are built into the chair.

SUMMARY

Some embodiments of the present disclosure include a chair for partially submerging a user in a body of water. The chair may include a frame formed of tubing, the frame configured to engage with a wall in the body of water; a seat supported by the frame; a backrest supported by the frame; at least one cylindrical foam pad encircling portions of the frame, such that the user is not completely submerged in the body of water when using the chair; an umbrella attached to the frame of the chair, the umbrella configured to extend upwards from the frame to shade a user; a mister attached through or along the frame, the mister having a spray nozzle and a tubing extending from the spray nozzle to the body of water; and a floatable and rotatable tray attached to the frame.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
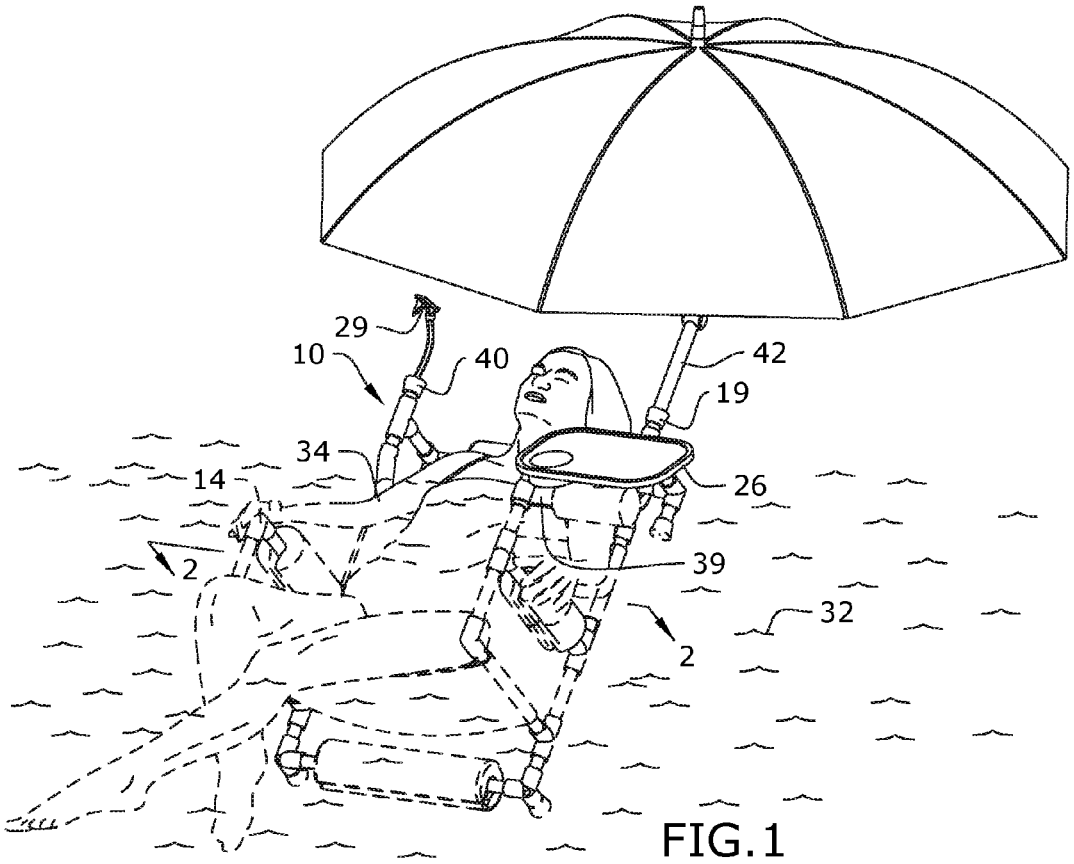
FIG. 1 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a water chair configured to hold a user in a partially submerged position, wherein the water chair may include attachments such as an umbrella, a mister, and a tray, and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Chair Frame
2. Seat and Backrest
3. Foam Pad
4. Mister
5. Umbrella
6. Tray

The various elements of the device of the present disclosure may be related in the following exemplary fashion. It is not intended to limit the scope or nature of the relationships between the various elements and the following examples are presented as illustrative examples only.

By way of example, and referring to FIGS. 1-9, some embodiments of the present disclosure include a water chair 10 for supporting a user 34 partially submerged in water 32, the water chair 10 comprising a frame; a seat 20 supported by the frame; a backrest 22 supported by the frame; and an accessory attached to the frame, wherein the accessory is at least one member selected from the group consisting of a plurality of foam pads 24, a tray 26, an umbrella 28, and a mister 29.

As shown in the Figures, the frame may comprise a plurality of tubular members connected together to form a generally chair shaped frame. In embodiments, the frame may either comprise separate pieces or one large piece molded together. Specifically, the frame may comprise a plurality of straight tubing 12 connected by various 2-way elbow fittings 14, 3-way elbow fittings 36, and T-fittings 16 to form: an upper cross member adapted to rest along a perimeter of a pool or on a deck or dock 30 to hold the chair 10 upright in the water 32 in a stationary position, enabling a user 34 to sit in the chair 10 with the user's lower torso and legs submerged in the water 32 and the user's head above the water 32; a pair of L-shaped side bars spaced apart to permit a user's upper torso to fit comfortably between said side bars, each side bar having a front element and a top element forming a right angle, said top element having one end connected to the cross member and another end connected to the front element; a back section including a pair of back braces which bear against the pool, deck, dock or the like 30 when the chair is submerged, each back brace having opposed lower and upper ends; a pair of arm members, each arm member being connected between a first intermediate portion of one of said back braces and an intermediate portion of one of the front elements, said arm members being disposed generally at a right angle to said one back brace and said one front element; a pair of seat bars, each seat bar having an end connected to a second intermediate portion of said one back brace below said first intermediate portion and another end connected to the front element; and a lower cross member connected between the lower ends of the back braces, wherein the portions of the frame that are configured to abut the pool, deck, dock, or the like 30 may be closed off with end caps 18. Thus, the frame of the chair 10 of the present disclosure may be similar to the frame described in U.S. Pat. No. 5,307,527.

Figure 2:
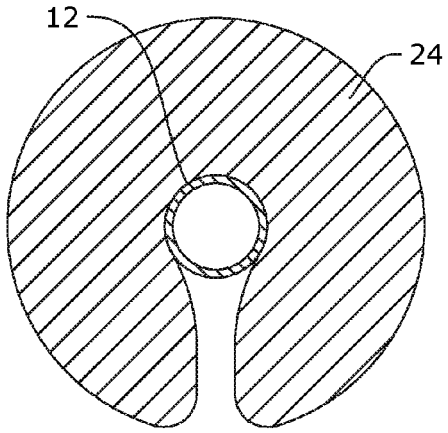
FIG. 2 is a section detail view of one embodiment of the present disclosure, taken along line 2-2 in FIG. 1.
Figure 3:
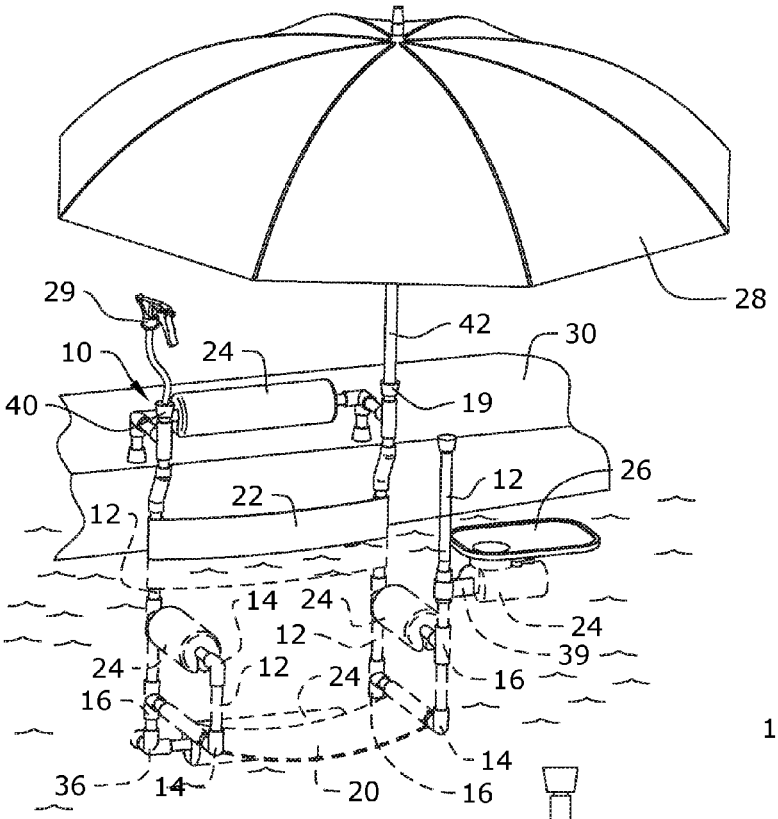
FIG. 3 is a perspective view of one embodiment of the present disclosure.
Figure 5:
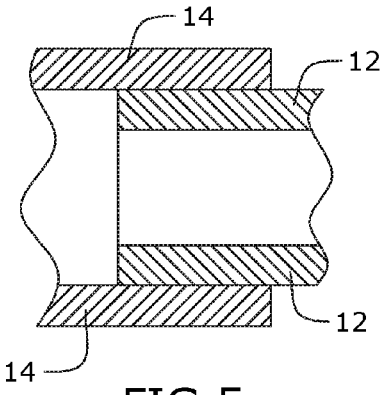
FIG. 5 is a section detail view of one embodiment of the present disclosure, taken along line 5-5 in FIG. 4.
Figure 4:
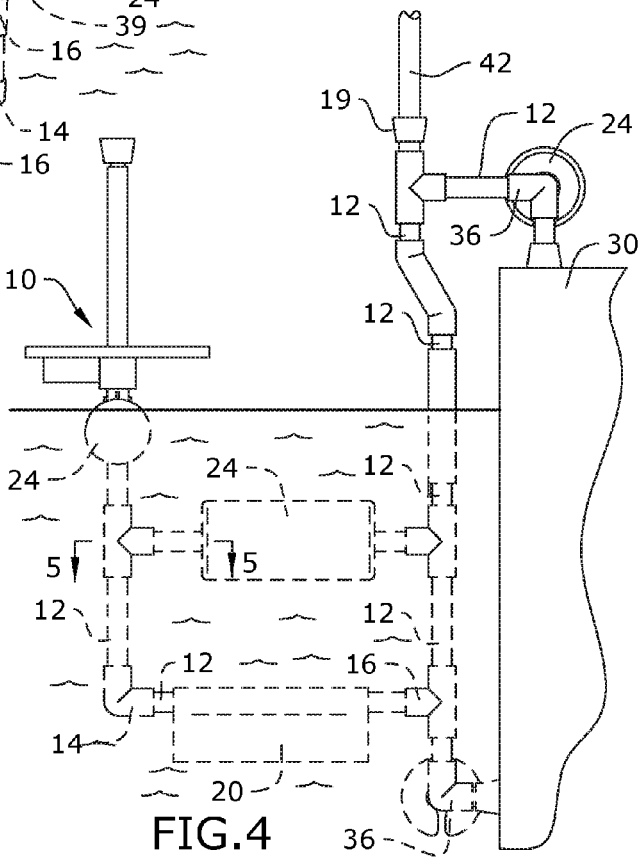
FIG. 4 is a side view of one embodiment of the present disclosure.

Embodiments of the chair 10 may comprise a chair 10 configured to free float (i.e., partially submerge a user without being positioned against the wall of a pool, dock, deck, or the like 30). Such embodiments may comprise a plurality of foam pads 24 attached to the frame and, particularly, to the straight tubing 12 portions of the frame. For example, each arm member may have a foam pad 24 attached thereto. Similarly, the upper cross member may have a foam pad 24 attached thereto. The lower cross member may also have a foam pad 24 attached thereto. In embodiments, all of the arm members, the upper cross member, and the lower cross member have a foam pad 24 attached thereto, as shown in FIGS. 3, 4, and 6-9. When the foam pads 24 are placed in suitable locations, the chair 10 may be able to free float in the water 32 while simultaneously supporting a user 34, as shown in FIG. 1. The foam pads 24 may be attached to the straight tubing 12 in any suitable manner and, in some embodiments, the foam pad 24 encircles the straight tubing 12, as shown in FIG. 2. This may be done by slipping the foam pad over the tubing 12. The foam pad 24 may have any desired shape and, in some embodiments, is substantially cylindrical with a center opening to allow the foam pad 24 to fit securely over the tubing 12.

Because the chair 10 of the present disclosure may often be used in open, sunny areas, a user 34 may desire the chair 10 to have a built-in shading device. Thus, in some embodiments, the chair 10 may comprise an umbrella 28 attached to the frame. For example, the umbrella 28 may be operatively attached to an umbrella pole 42 that is connected to the frame using an umbrella attachment 19. The umbrella attachment 19 may be configured to engage with a T-fitting 16 connected to an upper corner of the upper cross member. In some embodiments, the umbrella pole 42 may include an umbrella hinge 38, such that the angle of the umbrella 28 with respect to the user 34 can be varied, which may be advantageous as a user 34 changes positions in the chair 10 or moves around a body of water 32 or as the sun changes position in the sky.

Embodiments of the chair 10 of the present disclosure may also comprise a mister 29 to spray a user 34 to provide relief from the heat, as desired. The mister 29 may comprise a spray-nozzle type device, as shown in the Figures, that has tubing extending therefrom that is configured to run through or along the frame into the body of water 32, such that the mister 29 uses the water 34 in the pool, lake, river, ocean, or the like as a water supply, thus not requiring a separate pressurized canister or container to hold the water supply. The mister 29 may comprise a pressurized nozzle configured to produce a mist-like spray. As shown in the Figures, the mister 29 may be mounted to the frame in any desired location and, in some embodiments, is connected to the frame by a mister attachment 40 configured to engage with a T-fitting 16 connected to an upper corner of the upper cross member, such as the upper corner opposite the corner that the umbrella 28 is attached to.

Figure 6:
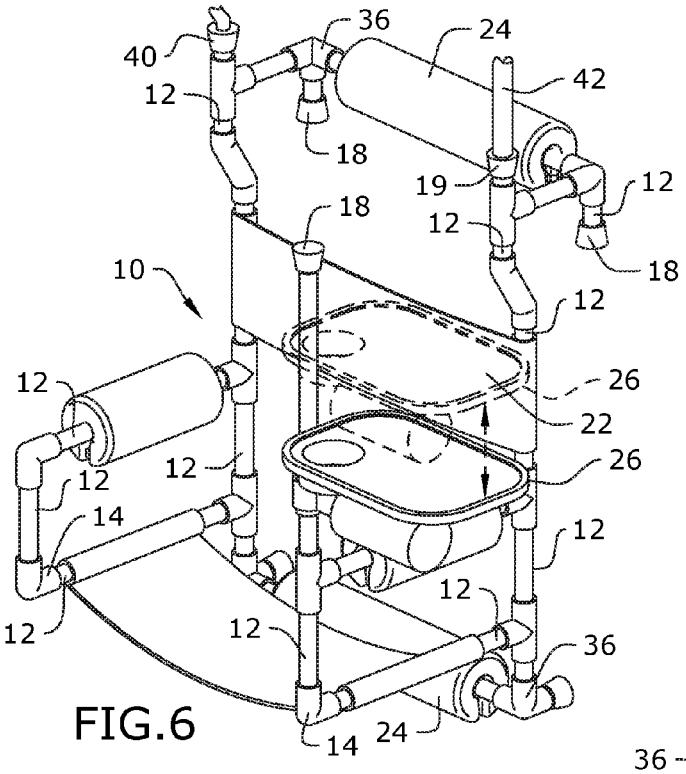
FIG. 6 is a front perspective view of one embodiment of the present disclosure.
Figure 7:
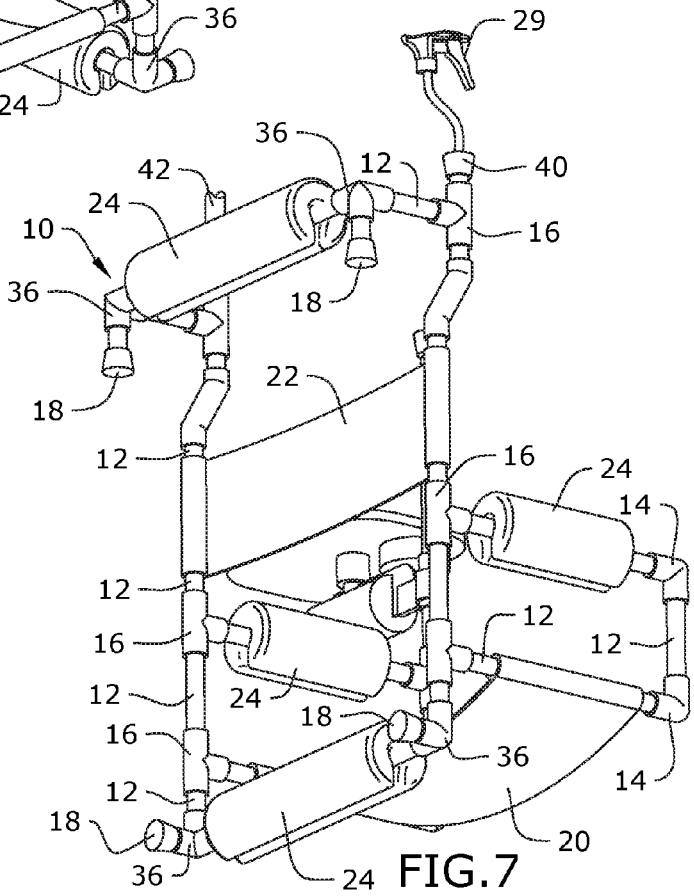
FIG. 7 is a rear perspective view of one embodiment of the present disclosure.
Figure 8:
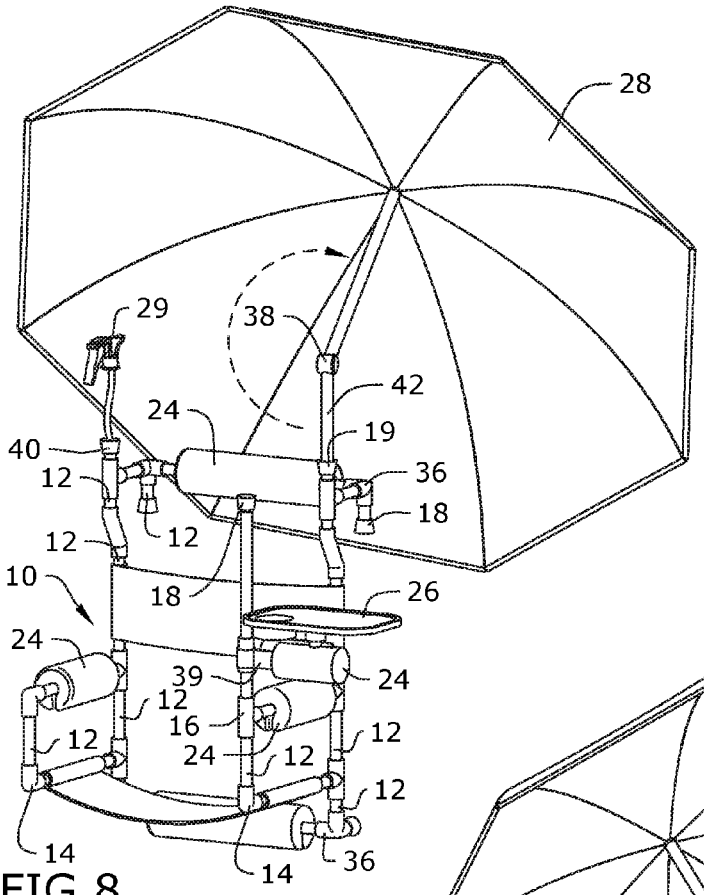
FIG. 8 is a perspective view of one embodiment of the present disclosure.
Figure 9:
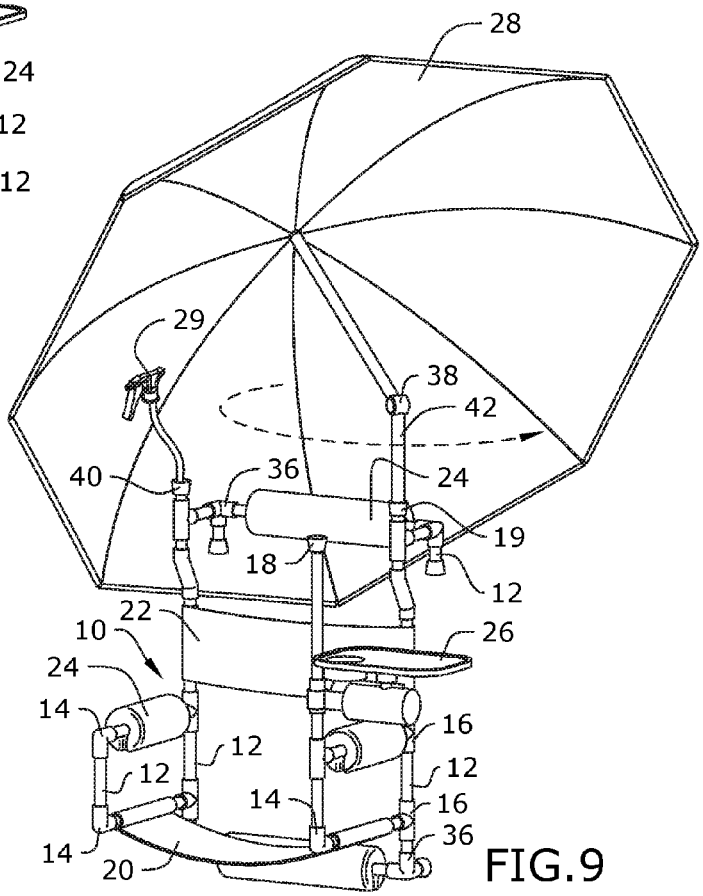
FIG. 9 is a perspective view of one embodiment of the present disclosure.

Embodiments of the chair 10 may also comprise a tray 26 attached to the frame, wherein the tray 26 may provide a surface to rest a personal item, such as a drink, a snack, glasses, a book, a phone, a tablet, or the like. In embodiments, the height of the tray 26 may be adjustable, as shown in FIG. 6. Specifically, the height of the tray 26 may be dependent on how far the chair 10 is submerged in the water 32, wherein the tray 26 may be designed to float on the surface of the water 32. Specifically, the frame may comprise an extra straight tubing 12 extending vertically upwards from one of the arm portions. A tray connector 39 may be slidably attached to the straight tubing 12, such that it can slide up and down the height of the straight tubing 12 and rotate from side to side.

The chair 10 of the present disclosure may be made using any suitable materials and, in some embodiments, comprises a furniture grade polyvinylchloride (PVC) pipe. The foam pads 24 may comprise a material similar to that used to form swim noodles. The remaining elements, such as the mister 29, the umbrella 28, and the tray 26 may be made of any suitable or desired materials.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A chair for partially submerging a user in a body of water, the chair comprising:

a frame formed of tubing;

a seat supported by the frame;

a backrest supported by the frame;

at least one foam pad attached to the tubing;

a tray attached to the frame; and an accessory attached to the frame, wherein:

the accessory is at least one member selected from the group consisting of an umbrella and a mister;

the at least one foam pad prevents the chair from completely submerging the user in the body of water;

the tray has an adjustable height;

the frame comprises an arm rest and a piece of straight tubing extending vertically from the arm rest;

the tray is slidably attached to the piece of straight tubing; and a foam pad is positioned below the tray, such that when the chair is submerged in the water, the foam pad causes the tray to slide up the piece of straight tubing.

2. The chair of claim 1, wherein the at least one foam pad comprises a cylindrical foam pad configured to encircle the tubing.

3. A chair for partially submerging a user in a body of water, the chair comprising:

a frame formed of tubing, the frame configured to engage with a wall in the body of water;

a seat supported by the frame;

a backrest supported by the frame; and a floatable and rotatable tray attached to the frame, wherein:

the floatable and rotatable tray has an adjustable height;

the frame comprises an arm rest and a piece of straight tubing extending vertically from the arm rest;

the tray is slidably attached to the piece of straight tubing; and a foam pad is positioned below the tray, such that when the chair is submerged in the water, the foam pad causes the tray to slide up the piece of straight tubing.

4. The chair of claim 3, further comprising at least one foam pad attached to the tubing, wherein the at least one foam pad prevents the chair from completely submerging the user in the body of water when the chair is not engaged with the wall.

5. A chair for partially submerging a user in a body of water, the chair comprising:

a frame formed of tubing, the frame configured to engage with a wall in the body of water;

a seat supported by the frame;

a backrest supported by the frame;

at least one cylindrical foam pad encircling portions of the frame, such that the user is not completely submerged in the body of water when using the chair;

an umbrella attached to the frame of the chair, the umbrella configured to extend upwards from the frame to shade a user;

a mister attached to the frame, the mister comprising a spray nozzle and a tubing extending from the spray nozzle; and a floatable tray attached to the frame, wherein:

the frame comprises an arm rest and a piece of straight tubing extending vertically upward from the arm rest;

the tray is slidably attached to the piece of straight tubing; and a foam pad is positioned below the tray, such that when the chair is submerged further into the water, the foam pad causes the tray to slide up the piece of straight tubing.

6. The chair of claim 5, wherein:

the umbrella is operatively attached to an umbrella pole, which is connected to the frame using an umbrella attachment; and the umbrella pole includes an umbrella hinge, allowing the angle of the umbrella with respect to the user to be adjusted.

* * * * *